United States Patent [19]

Garford

[11] Patent Number: 4,503,298

[45] Date of Patent: Mar. 5, 1985

[54] WHEEL MOTION INDICATOR

[76] Inventor: Andrew M. Garford, 10755 - 164 St., Edmonton, Alberta, Canada, T5P 3S1

[21] Appl. No.: 547,363

[22] Filed: Oct. 31, 1983

[51] Int. Cl.[3] ..... H01H 3/16; H01H 35/10

[52] U.S. Cl. ..... 200/61.39; 200/61.45 M; 200/61.46; 200/80 R; 200/DIG. 9; 200/DIG. 29

[58] Field of Search ..... 200/DIG. 29, 61.44, 200/61.45 R, 61.45 M, 61.46, 61.48, 61.52, 80 R, 61.39; 307/116; 340/669, 670, 671

[56] References Cited

U.S. PATENT DOCUMENTS

| | | | |
|---|---|---|---|
| 1,563,773 | 12/1925 | Meyers | 200/80 R |
| 1,896,798 | 2/1933 | Leslie | 200/80 R |
| 1,996,848 | 4/1935 | Arden | 200/80 R |
| 2,715,663 | 8/1955 | Bowes | 200/80 R |
| 2,744,976 | 5/1956 | Black | 200/80 R |
| 3,372,253 | 3/1968 | Baker et al. | 200/61.45 R |
| 3,435,164 | 3/1969 | De Perczel | 200/61.46 |
| 3,520,200 | 7/1970 | Rodgers | 200/61.45 R X |
| 3,619,524 | 11/1971 | Gillund | 200/52 R X |
| 3,622,722 | 11/1971 | Jackson et al. | 200/61.39 |
| 3,646,543 | 2/1972 | Morris | 307/116 |
| 3,763,484 | 10/1973 | Byers | 340/669 |
| 3,812,308 | 5/1974 | Bell et al. | 200/61.45 R |
| 3,927,286 | 12/1975 | Föhl | 200/61.45 R |
| 4,196,429 | 4/1980 | Davis | 200/61.45 X |

*Primary Examiner*—J. R. Scott

*Attorney, Agent, or Firm*—George H. Dunsmuir

[57] ABSTRACT

A device for sensing wheel rotation includes a cylindrical casing with a frusto-conical bottom end which defines a ramp for a steel ball in the casing; a shaft connected to the casing top for rotation by a vehicle wheel to cause the ball to ride up the ramp; a pair of annular contacts at the bottom of the ramp which are electrically interconnected by the ball when the wheel and consequently the shaft and casing stop rotating, whereby an electrical circuit including the contacts is closed to provide a signal indicating that rotation of the wheel has ceased.

6 Claims, 2 Drawing Figures

WHEEL MOTION INDICATOR

BACKGROUND OF THE INVENTION

This invention relates to a motion sensing device and in particular to a device for sensing rotation of a wheel.

With large multi-wheeled vehicles such as tractor-trailers it is important to know when any of the wheels stop rotating. In the absence of a motion sensor the driver of the vehicle has no way of knowing when a wheel locks, for example because of bearing failure.

The patent art includes many examples of motion sensing devices and more specifically motion sensing devices which rely on centrifugal force. Examples of motion sensing devices are found in U.S. Pat. No. 3,435,164 issued to D. de Perczel on Mar. 25, 1969; U.S. Pat. No. 3,619,524 issued to A. G. Gillund on Nov. 9, 1971; U.S. Pat. No. 3,646,543 issued to J. D. Morris on Feb. 29, 1972; U.S. Pat. No. 3,763,484 issued to W. L. Byers on Oct. 2, 1973; U.S Pat. No. 3,812,308 issued to L. E. Bell et al on May 21, 1974; U.S. Pat. No. 3,927,286 issued to A. Fohl on Dec. 16, 1975 and U.S. Pat. No. 4,196,429 issued to C. H. Davis on Apr. 1, 1980. Many of the devices disclosed by the above identified patents are unsuitable for sensing wheel rotation and others of the devices are unnecessarily complicated.

Thus, in spite of the large numbers of patents for such devices, there still exists a need for a simple yet effective device for sensing rotation of a wheel. The object of the present invention is to to meet such need, at least partially, by providing a relatively simple, effective device for sensing wheel rotation.

SUMMARY OF THE INVENTION

Accordingly, the present invention relates to a device for sensing wheel rotation for use in an electrical circuit of the type including a motion indicator, said device comprising a casing, said casing including a substantially cylindrical side wall, a top wall closing the upper end of said side wall and ramp means at the lower end of said side wall, said ramp means being inclined downwardly and inwardly toward the longitudinal axis of said casing; shaft means connected to said top wall for driving connection with a wheel, whereby rotation of the wheel causes rotation of said shaft means and of said casing, contact means in said casing at the lower end of said ramp means, said contact means including first and second spaced apart electrically conductive elements for separate electrical connection with said motion indicator; and an electrically conductive ball in said casing movable between the top and bottom ends of said ramp means, whereby when the wheel is rotating the ball moves to a position on said side wall remote from said electrically conductive elements and when rotation of said wheel ceases the ball moves down the ramp means into contact with said conductive elements to close the electrical circuit and actuate the said indicator.

BRIEF DESCRIPTION OF THE DRAWINGS

The invention will now be described in greater detail with reference to the accompanying drawing which illustrates a preferred embodiment of the invention and wherein.

DESCRIPTION OF THE PREFERRED EMBODIMENT(S)

Figure 1:
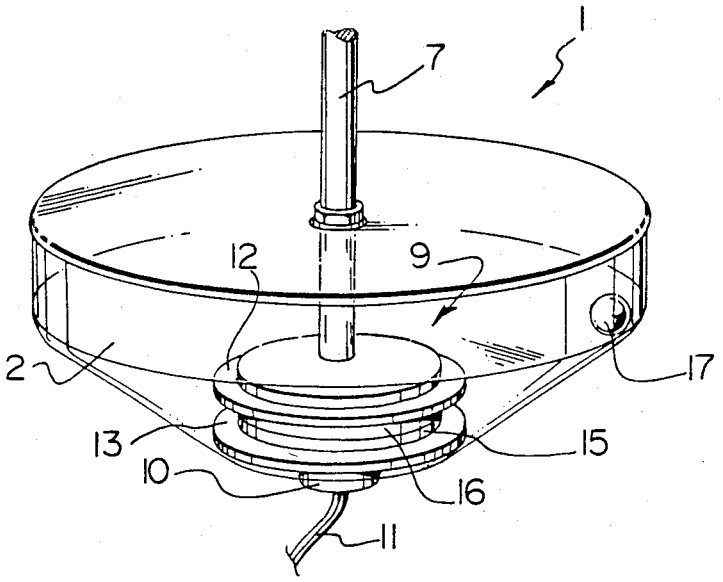
FIG. 1 is a perspective view from above of a device in accordance with the present invention.

With reference to the drawing, the device of the present invention is intended for use with a motion indicator (not shown) of the type including a console mounted in a vehicle cab with lights, one for each wheel. A light is turned on if the wheel to which the light is connected ceases to rotate. Of course a master switch is included on the console for de-activating the entire device, otherwise all lights would be on when the vehicle was stopped. Thus, the device of the present invention is in effect a switch in an electrical circuit, including a light for indicating wheel movement.

The device of this invention includes a casing generally indicated at 1. The casing 1 is defined by a cylindrical side all 2, a planar top wall 3 and a frusto-conical bottom wall 4. The bottom wall 4 includes a downwardly and inwardly inclined ramp portion 5, which is slightly bowed outwardly and a planar, horizontal lower portion 6. The side, top and bottom walls of the casing are formed of a hard plastic or other electrically non-conductive material.

A shaft 7 extends into the casing 1 through the top wall 3. The shaft 7 is connected to the top wall 3, so that rotation of the shaft 7 results in corresponding rotation of the casing 1. A disc 8 is mounted on the top end of the shaft 7 for constantly engaging the inner surface of a vehicle wheel or rim (not shown), so that rotation of the wheel is transmitted to the shaft 7 and the casing 1.

The bottom end of the shaft is rotatably mounted in the top end of a contact generally indicated at 9. The contact structure 9 is fixedly mounted in the bottom of the casing 1, for example, the structure 9 remains fixed when the casing 1 rotates. The contact structure 9 includes a sleeve bearing 10, through which an electrical lead 11 passes to connect the contact structure to the indicator circuit described hereinbefore. A pair of annular contacts 12 and 13 are mounted on the bearing 10 in parallel spaced apart relationship to each other above the lower portion 6 of the bottom wall 4. The contacts 12 and 13 are separated by rings 14 and 15 of insulative material, for example, plastic and by an annular magnet 16. One wire of the pair of wires forming the lead 11 is connected to each of the contacts 12 and 13. The casing contains a metal ball 17.

Motion of the ball 17 in the casing 1 is controlled by a bumper 18 and a stop 19. The bumper 18 is generally a wedge-shaped plastic block mounted on the ramp portion 5 of the bottom wall near the contacts 12 and 13. The stop 19 is defined by a plastic block mounted on the inner surface of the side wall 2 at the top of the ramp portion 5 of the bottom wall.

Figure 2:
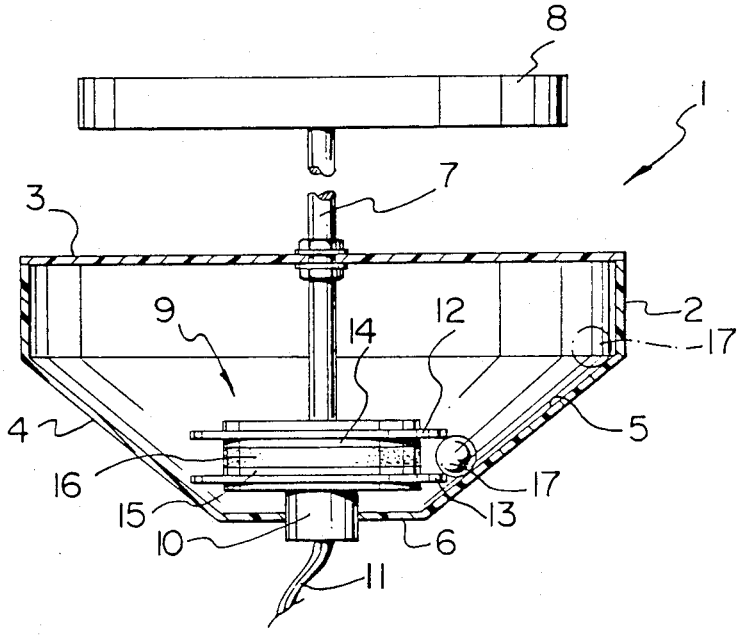
FIG. 2 is a longitudinal sectional view of the device of FIG. 1.

In operation with the vehicle wheel stationary, the casing 1 is stationary and the ball 17 rest against the bumper 18 and against the contacts 12 and 13 (the solid line ball position of FIG. 2). When the vehicle is travelling, for example, when the wheel is rotating, the disc 8 shaft 7 and casing 1 are also rotating around the longitudinal axis of the shaft 7. Centrifugal force causes the ball 17 to travel outwardly away from the centre of the casing 1 up the ramp 5 to a position against the stop 19 and the side wall 2, as shown in phantom outline in FIG. 2. In such position of the ball 17 the circuit including the lead 11 and the contacts 12 and 13 is open. When the console in the truck cab is switched on none of the indicator lights is "ON". If one of the wheels ceases to rotate the corresponding disc 8, shaft 7 and casing 1 also stop. The ball 17 rolls down the ramp 5. Because of the bumper 18 prolonged rotation of the ball 17 is avoided and the ball 17 stops in contact with the contacts 12 and 13 to complete the electrical circuit and provide an indication that the wheel is no longer in motion. Good contact between the ball 17 and the contacts 12 and 13 is assured by the magnet 16 which pulls the ball 17 toward the centre of the casing 1 and against the periphery of the contacts 12 and 13. The magnet 16 is not sufficiently strong to prevent outward movement of the ball 17 when the wheel is rotating.

It will be appreciated that one device is required for each wheel. It will also be appreciated that the motion indicator in the cab could be an LED display panel, a flashing light and possibly one or more sound emitting devices for simultaneous actuation with the visual indicator.

What I claim is:

1. A device for sensing wheel rotation for use in an electrical circuit of the type including a motion indicator, said device comprising a casing, said casing including a substantially cylindrical side wall a top wall closing the upper end of said side wall, and ramp means at the lower end of said side wall; said ramp means being inclined downwardly and inwardly toward the longitudinal axis of said casing; shaft means connected to said top wall for driving connection with a wheel, whereby rotation of the wheel causes rotation of said shaft means and of said casing; contact means in said casing at the lower end of said ramp means, said contact means including first and second spaced apart electrically conductive elements for separate electrical connection with said motion indicator; and an electrically conductive ball in said casing movable between the top and bottom ends of said ramp means whereby when the wheel is rotating the ball moves to a position on said side wall remote from said electrically conductive elements and when rotation of said wheel ceases the ball moves down the ramp means into contact with said conductive elements to close the electrical circuit and actuate said indicator.

2. A device according to claim 1 wherein said contact means includes a magnet between said conductive elements for drawing said ball against said conductive elements to ensure good electrical contact between the ball and conductive elements.

3. A device according to claim 1 including a bottom wall said ramp means extending between the lower end of said side wall and said bottom wall.

4. A device according to claim 3 wherein said ramp means is substantially frusto-conical.

5. A device according to claim 1, 2 or 4 including bumper means at the bottom end of said ramp means for preventing rotation of said ball in said casing at the bottom of the ramp, whereby contact between said ball and said conductive elements is promoted.

6. A device according to claim 1, 2 or 3 including stop means at the top end of said ramp means for preventing rotation of said ball with said casing.

* * * * *